US007980687B2

(12) United States Patent
Nip

(10) Patent No.: US 7,980,687 B2
(45) Date of Patent: Jul. 19, 2011

(54) OUTER COVER FOR INK CARTRIDGES

(75) Inventor: Shui Kuen Nip, North Point (HK)

(73) Assignee: Powerful Way Limited, North Point (HK)

( * ) Notice: Subject to any disclaimer, the term of this patent is extended or adjusted under 35 U.S.C. 154(b) by 844 days.

(21) Appl. No.: 11/971,344

(22) Filed: Jan. 9, 2008

(65) Prior Publication Data

US 2008/0211897 A1 Sep. 4, 2008

(30) Foreign Application Priority Data

Jan. 9, 2007 (CN) ..... 2007 2 0047262 U

(51) Int. Cl.
*B41J 2/175* (2006.01)

(52) U.S. Cl. ..... 347/87

(58) Field of Classification Search ..... 347/49, 347/85; 215/237; 220/254.3
See application file for complete search history.

(56) References Cited

U.S. PATENT DOCUMENTS

| | | | | |
|---|---|---|---|---|
| 5,373,936 | A * | 12/1994 | Kawai et al. | 206/204 |
| 5,821,967 | A * | 10/1998 | Solero | 347/87 |
| 6,170,940 | B1 * | 1/2001 | Shinada et al. | 347/86 |
| 6,502,917 | B1 * | 1/2003 | Shinada et al. | 347/19 |
| 7,452,066 | B2 * | 11/2008 | Tsuji | 347/108 |
| 7,585,123 | B2 * | 9/2009 | Ueda et al. | 400/56 |

* cited by examiner

*Primary Examiner* — Anh T. N. Vo
(74) *Attorney, Agent, or Firm* — Rabin & Berdo, P.C.

(57) ABSTRACT

The present invention provides an outer cover to secure a printhead-ink cartridge and can be used in a segregated printhead-ink cartridge which is modified from an all-in-one printhead-ink cartridge. The inner and outer mounting and matching dimensions of the outer cover fit the outer frame edge (2) of the printhead and the printhead rack. The outer cover is an integrated cartridge holder comprising functional parts including locking tabs (4*a*,4*b*), at least one outer cover operating handle (3), at least one printhead locking tab (7), at least one printhead operating handle (5), and at least one pressing rib (6). The outer cover ensures that the ink cartridge (8) is securely mounted in the frame of printhead (1) and that the printhead is accurately positioned in the printhead rack. When the ink is depleted only the ink cartridge inside the printhead needs to be replaced.

5 Claims, 1 Drawing Sheet

OUTER COVER FOR INK CARTRIDGES

FIELD OF THE INVENTION

The present invention relates to a segregated printhead-ink cartridge which is modified from an integrated printhead-ink cartridge. More particularly, the present invention relates to the construction methods of the installation and detachment between the ink cartridge and the printhead and between the printhead and the printhead rack.

BACKGROUND OF THE INVENTION

It is well-known that in an integrated printhead-ink cartridge, the printhead and the ink cartridge are non-removably connected together therein the cover of the ink cartridge is fixed to the printhead frame by non-removable methods such as welding or the like. Generally, the ink is stored directly inside a printhead chamber and when the ink is depleted, the entire ink cartridge together with the printhead is required to be replaced and discarded. This results in high costs both in manufacturing and in using the printing consumables. As a result, it causes not only unnecessary waste but also environment pollution because of the large amount of this mixed electronic waste which is difficult to dispose of and recycle.

In dealing with the problems mentioned above, there exists a segregated printhead-ink cartridge that is made from modifying an integrated printhead-ink cartridge, in which the ink cartridge is detachably connected with the printhead and is an independent functional entity inside the printhead. The ink cartridge itself is a single-use disposable consumable whereas the printhead can be used repeatedly. The securement of the ink cartridge to the printhead basically employs one of the following methods: (1) a securement method using raised ribs integrally connected with the ink cartridge, wherein the raised ribs match with the grooves which are formed from complicated mechanical machining process on the inside wall surfaces of the printhead frame; (2) a securement method using the locking tabs of elastic cartridge-claws which are integrally connected with the ink cartridge, wherein the locking tabs match with the outer frame edge of the printhead; and (3) a securement method using a movable sleeve which is separate from the ink cartridge, wherein the movable sleeve is open at one end and slidably fits over the outer frame edge of the printhead. In method (1) above, the fact that the grooves have to be formed by a complicated machining process and the frame wall of the printhead is not elastic enough to allow the raised ribs to fit and lock into the grooves or to be easily pulled out of the grooves makes the removal and installation of the ink cartridge very difficult. Thus, ordinary users are not able to process and recycle the depleted ink cartridge but instead have to buy the entire set of printhead and ink cartridge provided by some specialised manufacturers. In method (2) above, the fact that the elastic cartridge-claws are integrally connected to the ink cartridge means that it is an unnecessary waste of materials after the single-use ink cartridge is depleted of ink. In method (3) above, the fact that the slidable sleeve is not fully constrained and is therefore prone to move along the outer frame edge of the printhead under certain abnormal circumstances means that the securement of the ink cartridge is not quite reliable.

SUMMARY OF THE INVENTION

The object of the present invention is to improve the securement method of fixing the ink cartridge in the printhead, so that the need to perform a complicated machining process on the frame of the printhead can be eliminated, the reliability of securement of both the ink cartridge inside the printhead frame and the printhead on the printhead rack can be improved and also the mounting and detaching operations of the ink cartridge can be easily performed by ordinary users.

The above mentioned object of the present invention is realised by the following. An outer cover to be used as an assembly-securement member in a printhead-ink cartridge and to be detachably mounted to an outer frame edge of the printhead of a segregated printhead-ink cartridge, the outer cover comprising: an operating handle provided at one end of the outer cover, a printhead locking tab disposed at the upper surface of the other end of the outer cover (and which is designed to fit with the printhead rack), and locking tabs located at two ends of the lower surface of the outer cover for engaging and matching with the outer frame edge of the printhead to detachably mount the outer cover to the outer frame edge, at least one locking tab being provided on the outer cover operating handle and at least a pair of locking tabs being provided at the said other end of the outer cover and defining pivot points about which the outer cover can be pivoted relative to the printhead when the outer cover is mounted to, and detached from, the outer frame edge.

The inner and outer mounting and matching dimensions of the outer cover fit with the outer frame edge of the printhead and the printhead rack respectively so that not only the ink cartridge can be reliably and securely fixed inside the printhead frame but also the printhead can be accurately positioned in the printhead rack. Furthermore, the connections between the ink cartridge and the printhead frame and between the printhead and the printhead rack become detachably connectable. When the outer cover presses upon the ink cartridge making it securely fixed inside the printhead frame, the ink cartridge is completely constrained, unmovable and securely connected, thereby generating a substantial and stable pressure on the upper surface of the ink cartridge and maintaining a reliable end sealing between the ink supply port at the lower side of the ink cartridge and the inkjet path of the printhead. In addition, this simple mounting and detaching method allows ordinary users to perform the removal and installation of the ink cartridge in an easy and simple manner without the need of performing complicated machining operation on the printhead. When the ink is depleted, what is needed is just to replace the ink cartridge only. Whereas the outer cover together with the printhead can be used repeatedly so that the cost of manufacturing and the cost of using the printing consumables can be lowered.

BRIEF DESCRIPTION OF THE DRAWINGS

Detailed structures of the present invention are shown in the following embodiment and drawings.

Figure 1:
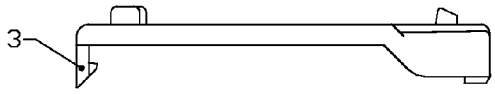
FIG. 1 is a front view of an outer cover.
Figure 2:
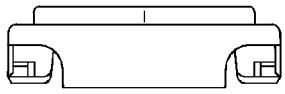
FIG. 2 is an end view of the outer cover depicted in FIG. 1.
Figure 3:
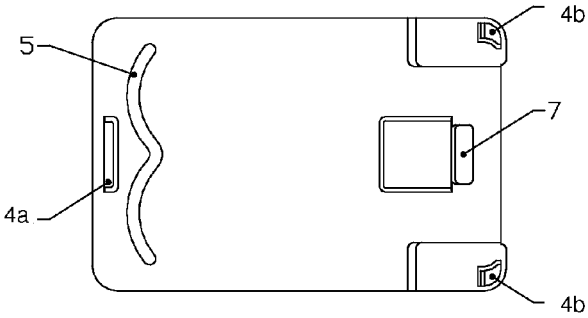
FIG. 3 is a top view of the outer cover depicted in FIG. 1.
Figure 4:
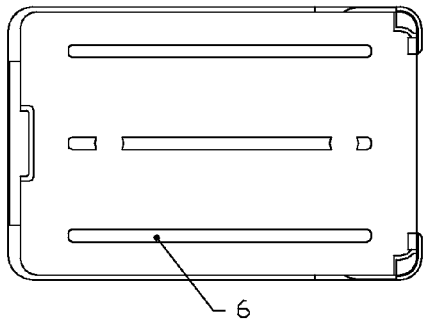
FIG. 4 is a bottom view of the outer view depicted in FIG. 1.

In these figures, the labels and their corresponding part names are:

"1" printhead,

"2" external frame edge of the printhead,

"3" outer cover operating handle,

"4*a*" and "4*b*" locking tabs of the outer cover,

"5" printhead operating handle,

"6" pressing rib,

"7" printhead locking tab, and

"8" ink cartridge.

DETAILED DESCRIPTION OF THE PREFERRED EMBODIMENTS

As shown in FIG. 1 to FIG. 5, an independent outer cover is installed at the outer frame edge 2 of the printhead 1. An outer cover operating handle 3 is provided at one end of the outer cover and a printhead locking tab 7, which fits with the printhead rack, is disposed at the upper surface of the other end. Outer cover locking tabs 4*a* and 4*b* which fit with the external frame edge 2 of the printhead 1 are provided at the opposite ends of the lower surface of the outer cover. More particularly, a single locking tab 4*a* at one end of the outer cover is disposed at the bottom of the inner side of the outer cover operating handle 3 and a pair of symmetric locking tabs 4*b* is provided at the other end of the outer cover. The outer cover operating handle 3, which is disposed at one end of the outer cover, is resilient and on which serrations or rough surfaces may be provided in order to increase friction with the user's fingers. The printhead locking tab 7, which is disposed at the other end of the outer cover, has an inclined upper plane on its upper surface. At least one pressing rib 6 is provided on the lower surface of the outer cover. A printhead operating handle 5, which is of a pair of arcuate walls that conform with the fingers of the user, is provided at the upper surface of the outer cover near the end where the operating handle 3 is located.

Figure 5:
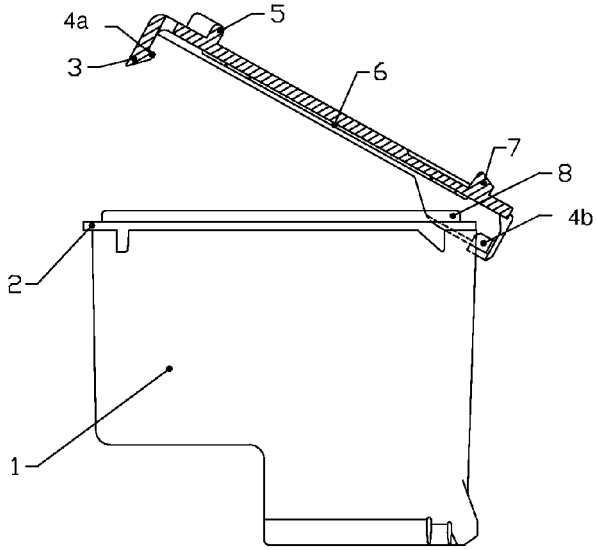
FIG. 5 is longitudinal cross-sectional view along the centre of the outer cover before mounting onto the external frame edge of a printhead.

The outer cover, which is made of a resilient material such as thermoplastic or the like, is an integrated assembly-securement holder. The pressing ribs 6 which are disposed at the lower surface of the outer cover are used to lock the ink cartridge 8 in place by coming into contact with and pressing against the upper surface of the ink cartridge. The locking tabs 4*a* and 4*b* are used to lock the outer cover to the outer frame edge 2 of the printhead 1. Each locking tab is of inverted hook shaped construction. By the traction of the operating handle 3, the first locking tab 4*a* which is disposed at the lower side of the inner surface of the resilient outer cover operating handle 3, is to facilitate the mounting and detaching of the outer cover to and from the left-hand side of the outer frame edge 2 as shown in FIG. 5. The second locking tabs 4*b*, which are disposed at the right-hand side of the outer cover, act as the centre of pivoting the entire outer cover during mounting and detaching of the outer cover. The outer cover operating handle 3 is an operational part for mounting and detaching the outer cover to and from the printhead outer frame edge 2. The operating handle 3 is slightly curved up to the left in order to provide space for the user's finger to operate it. The length of the operating handle 3 is suitably designed to be long enough to maximize the operating leverage so as to reduce the operating effort required to be exerted by the user's fingers. In addition, a rough surface or serrations may be optionally provided on the surface of the operating handle 3 so as to increase friction with the user's finger and therefore allow the user to operate the handle with a firmer grip and better stability. When the user operates the operating handle 3, due to the elastic property of the material from which the operating handle is made, while pivoting about its base the operating handle pivotally moves the locking tabs 4*a* clockwise or counter-clockwise within a certain angle about the base, thereby allowing easy removal or securement of the outer cover by unlocking or locking the locking tab 4*a*. The printhead locking tab 7 which is disposed at the right upper surface of the outer cover is a rib structure with its upper surface inclined to the right and is designed to lock the printhead 1 correctly onto the printhead rack (not shown). The inclined upper surface of the locking tab 7 is used to reduce the locking resistance of the printhead locking tab 7. The printhead operating handle 5 which is designed to be held by the user when detaching or mounting the printhead onto the printhead rack (not shown) is disposed at the left upper surface of the outer cover and is designed as two arcuate walls construction with suitable height rising above the surface in order to prevent the user's fingers from slipping off when mounting or detaching the printhead.

The inner and outer mounting and matching dimensions of the outer cover fit respectively with the outer frame edge 2 of the printhead 1 and the printhead rack (not shown) so that not only the ink cartridge 8 is reliably and securely fixed inside the printhead frame thereby resulting in a reliable end surface sealing between the ink supply port (not shown) at the bottom of the ink cartridge and the inkjet path (not shown) in the printhead, but also the printhead 1 can be accurately positioned in the printhead rack (not shown). Furthermore, the connection between the ink cartridge 8 and the printhead 1 and that between the printhead 1 and the printhead rack (not shown) become detachably connectable.

The method of using the outer cover is now described as follows. Insert an ink cartridge 8 inside the printhead frame which is adapted from a modified integrated printhead-ink cartridge by removing the welded top cover from the frame edge and the ink absorbent material from the printhead chamber. Then install and securely lock the outer cover in position. More particularly, engage the two locking tabs 4*b*, which are disposed at the right-hand end corners of the lower surface of the outer cover (as shown in FIG. 5) with the two corners at the right side of the frame edge. Press at the operating handle 5 of the outer cover to allow the entire outer cover to rotate pivotally about the locking tabs 4*b* at the right-hand end of the outer cover and until the locking tab 4*a* at the left end of the outer cover snaps and locks under the bottom surface of the left-hand end of the frame edge. The installation and securement of the outer cover is then finished. The installation of the printhead with the secured outer cover to the printhead rack (not shown) inside the printer can be accomplished by pressing on the outside surface of the operating handle 3, thereby making the inclined upper plane on the top surface of the printhead locking tab 7 slide over the groove edge and snap into the groove inside the printhead rack.

When the ink inside the ink cartridge 8 is depleted causing discolored or faded prints, the ink cartridge can be replaced by the following procedures. Open the cover of the printer and press downward on the printhead operating handle 5 which is disposed on the upper surface of the outer cover, so as to release the printhead locking tab 7 which is disposed on the upper surface of the outer cover from the locking groove in the printhead rack (not shown) of the printer. The printhead can now be removed from the printer. Pull the resilient locking cover operating handle outwardly (i.e. upwardly and to the left in FIG. 5) and rotate the first locking tab 4*a* about the base of the operating handle 3 in order to release the locking tab 4*a* from the outer frame edge 2. Continue to rotate the operating handle 3 about the locking tabs 4*b* on the right side of the locking cover through a certain angle and slightly push the locking cover to the right in order to disengage the locking tabs 4*b* from the outer frame edge 2. The outer cover is now completely detached and can be removed. After replacing the depleted ink cartridge 8 with a new one inside the printhead frame, the original outer cover can then be installed back and securedly fixed to the outer frame edge 2 and the printhead can be installed back into the printer. Therefore, the outer cover and the printhead are able to be used again. By repeating the above cycles of replacement and usage, several ink cartridges can be used during the effective service lives of both the outer cover and the printhead.

Moreover, the outer cover can be used as a replacement of the welded top cover in an integrated printhead-ink cartridge. In other words, the outer cover can be mounted on the outer frame of the printhead of an integrated printhead-ink cartridge after removing the welded top cover but and without removing the ink absorbent material, thereby replacing the undetachable welded top cover with a detachable outer cover, so as to facilitate both the opening and closing of the ink cartridge cover of the printhead thereby making the ink filling or refilling operation in the printhead frame easier and more convenient.

The invention claimed is:

1. An outer cover to be used as an assembly-securement member in a printhead-ink cartridge and to be detachably mounted to an outer frame edge of a printhead of a segregated printhead-ink cartridge, the outer cover comprising:

an operating handle provided at one end of the outer cover, a printhead locking tab provided at an upper surface and at another end of the outer cover, locking tabs located at two ends of a lower surface of the outer cover for engaging and matching with the outer frame edge of the printhead to detachably mount the outer cover to the outer frame edge, at least one of the locking tabs being provided on the operating handle, and at least a pair of the locking tabs being provided at the another end of the outer cover and defining pivot points about which the outer cover can be pivoted relative to the printhead when the outer cover is mounted to, and detached from, the outer frame edge; and a printhead operating handle located at the upper surface of the outer cover, and having a pair of arcuate walls.

2. An outer cover according to claim 1, wherein the operating handle of the outer cover is resilient.

3. An outer cover according to claim 1, wherein the printhead locking tab has an inclined plane on its upper surface.

4. An outer cover according to claim 1, further comprising at least one pressing rib on a lower surface of the outer cover.

5. An outer cover according to claim 1, wherein the printhead operating handle is provided at the one end of the outer cover.

* * * * *